US005281243A

United States Patent [19]

Leininger

[11] Patent Number: 5,281,243

[45] Date of Patent: Jan. 25, 1994

[54] TEMPERATURE MONITORING BURNER MEANS AND METHOD

[75] Inventor: Thomas F. Leininger, Walnut, Calif.

[73] Assignee: Texaco, Inc., White Plains, N.Y.

[21] Appl. No.: 367,925

[22] Filed: Jun. 19, 1989

[51] Int. Cl.[5] ..... C10L 5/00

[52] U.S. Cl. ..... 44/629; 44/639; 431/12; 431/79; 431/90; 48/197 R

[58] Field of Search ..... 431/79, 90, 12; 44/629, 44/639; 48/197 R

[56] References Cited

U.S. PATENT DOCUMENTS

| | | | |
|---|---|---|---|
| 3,890,111 | 6/1975 | Knudsen | 431/3 |
| 4,035,133 | 7/1977 | Larcen | 431/90 |
| 4,142,417 | 3/1979 | Cashdollar et al. | 374/110 |
| 4,350,103 | 9/1982 | Poll | 210/264 |
| 4,410,266 | 10/1983 | Seider | 431/79 |
| 4,523,529 | 6/1985 | Poll | 210/264 |
| 4,523,530 | 6/1985 | Kominaka et al. | 110/264 |
| 4,579,461 | 4/1986 | Rudolph | 374/126 |
| 4,597,734 | 7/1986 | McCausland | 431/328 |
| 4,842,510 | 6/1989 | Grunden et al. | 431/90 |
| 4,899,671 | 2/1990 | Bass | 110/344 |
| 4,927,357 | 5/1990 | Yap | 431/10 |

*Primary Examiner*—Margaret Medley

*Attorney, Agent, or Firm*—James J. O'Loughlin; Ronald G. Gillespie

[57] ABSTRACT

A burner comprises a plurality of nozzles used to introduce a reactive mixture of hydrocarbon fuel and an oxidizing gas into a reaction chamber where synthesis gas is produced. A pyrometer connected to the nozzles senses the temperature of the reaction chamber.

6 Claims, 2 Drawing Sheets

TEMPERATURE MONITORING BURNER MEANS AND METHOD

BACKGROUND OF THE INVENTION

Field of the Invention

The present invention relates to burners and temperature sensors in general and more particularly, to burners and temperature sensors used in the conversion of hydrocarbon fuels into synthesis gas.

SUMMARY OF THE INVENTION

A burner comprises a plurality of nozzles used to introduce a reactive mixture of hydrocarbon fuel and an oxidizing gas into a reaction chamber where synthesis gas is produced. A pyrometer connected to the nozzles senses the temperature of the reaction chamber.

The objects and advantages of the invention will appear more fully hereinafter from a consideration of the detailed description which follows, taken together with the accompanying drawings, wherein one embodiment of the invention is illustrated by way of example. It is to be expressly understood, however, that the drawings are for illustration purposes only and are not to be construed as defining the limits of the invention.

DESCRIPTION OF THE INVENTION

Figure 1:
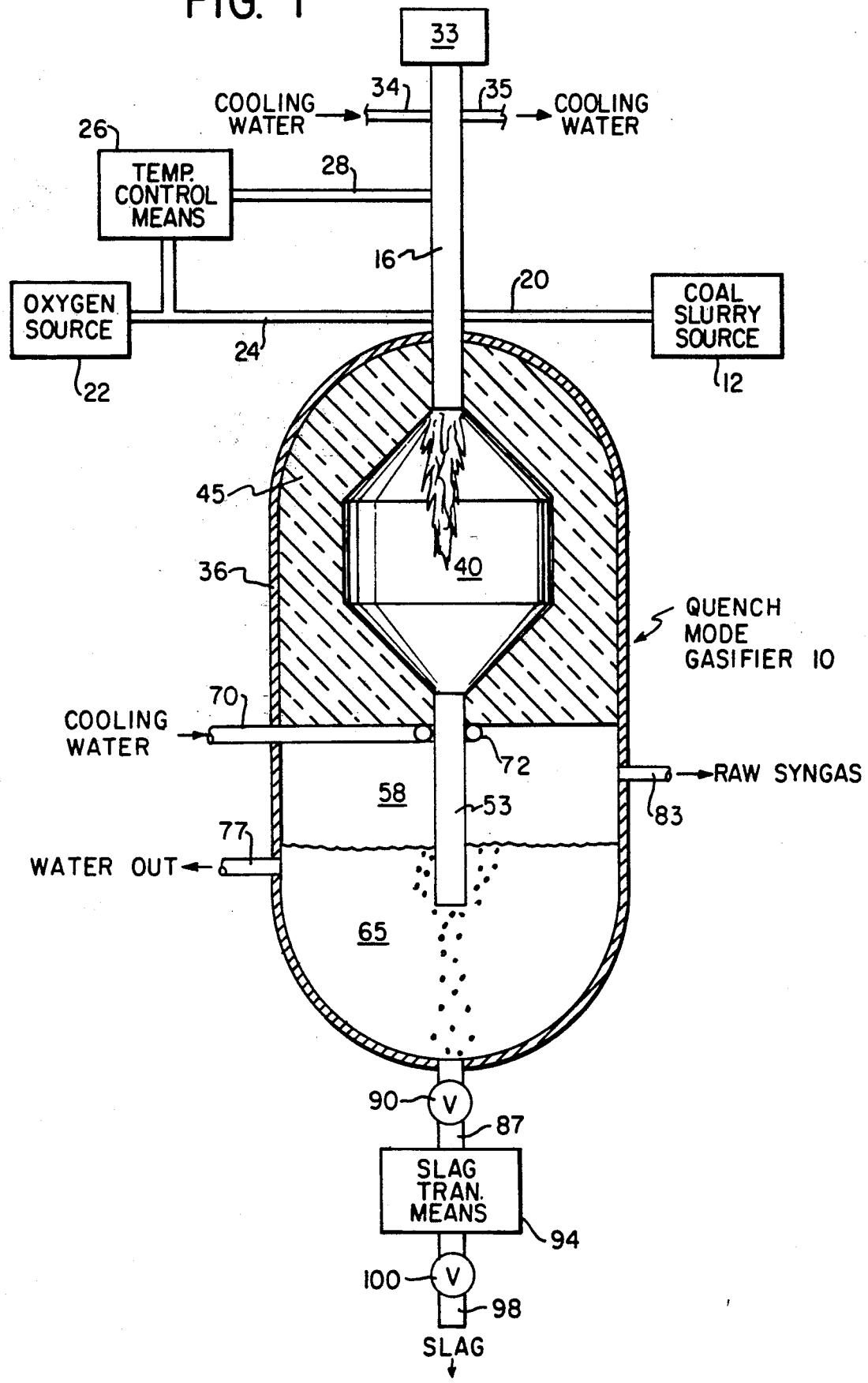
FIG. 1 is a graphical representation of a quench mode gasification system utilizing a temperature monitoring burner constructed in accordance with the present invention.

In the gasification of a hydrocarbon fuel such as coal or coke, for example, the fuel, in particulated form, is fed into the gasifier reaction chamber together with an oxidizing gas. Reaction of the particulated fuel with the oxidizing gas results in the production of a raw synthesis gas which is carried from the gasifier for further treatment. The events within the reaction chamber produce not only a usable gas, but also a slag having a constituency which depends to a large degree on the fuel being burned. Since the gasifier for this purpose must be operated at a relatively high temperature and pressure which is well known in the industry, conditions within the combustion chamber must be monitored at all times. Of particular importance, during the initial start-up period when the fuel and oxidant mixture is injected into the reaction chamber, it is essential that the reaction ignition event takes place immediately. Any substantial delay could permit the accumulation of unsafe quantities of fuel and gas to the point where there is the danger of having an uncontrolled explosion within the reaction chamber as well as within other process equipment downstream of the gasifier. It is desirable, therefore, as a safety measure, to monitor the temperature within the gasifier not only during periods of normal operation, but also during the initial startup stage.

Normally, gasifiers are equipped with one or more temperature monitoring devices. One such device is the thermocouple, a plurality of which may be disposed throughout the refractory lined walls of the gasifier reaction chamber. The thermocouples are placed in the gasifier in such a way that they are separated by a thin layer of refractory from the flames in the reaction chamber. This is done to protect the relatively fragile thermocouple junctions from the very aggressive environment inside the reaction chamber. Consequently, the thermocouples do not sense the reaction temperature directly, but instead respond to the heat transmitted through the thin refractory layer from the reaction chamber. It can be appreciated that, as a result of the lag-time inherent in conductive heat transfer, there can be a considerable delay in thermocouple response to critical changes. This is especially true during gasifier startup when reaction initiation results in a rapid temperature rise which must be detected in order to confirm that the reactions have initiated and that unsafe levels of unreacted material are not accumulating within the gasifier and other downstream equipment. In addition, heat transfer lag-times effect thermocouple response to operating condition changes during normal gasifier operation.

As an alternative to thermocouples, pyrometers are sometimes used to measure reaction temperature. Physically, the pyrometer is mounted external to the reactor and views the reaction chamber through a gas purged sight tube which normally extends from the pyrometer to the reaction chamber.

A major weakness of the pyrometer temperature monitor arises from the difficulty encountered in keeping the sight tube free of obstructions. The potential for obstruction is great, resulting from the atmosphere within the reaction chamber which is characterized by rapid swirling of particulate carrying gas. Further, a slag which results from ungasifiable material within the fuel, will likewise swirl around the reaction chamber, contacting the walls of the latter. In the course of gravitating towards the lower end of the gasifier, slag normally displays a tendency to cling to the reaction chamber walls. The clinging slag and the swirling particles interfere with the operation of the pyrometer sight tubes which are positioned in the reaction chamber walls. In addition, during the gasifier startup sequence, fuel is introduced into the reactor before oxidant. Depending upon the circumstances and upon the fuel, coal-water slurry for example, there exists an increased tendency for obstruction of the pyrometer sight tubes with unreacted fuel.

These obstructions prevent verification of startup by the pyrometer's response to reactor temperature change. While the problem of obstruction of the pyrometer sight path can in many instances be dealt with by proper adjustment of the sight tube purge gas, there are some difficulties inherent in the use of purge gas itself. If recycled process gas is used, the gas must first be cleaned so that it is entirely free of moisture and particulates, and then compressed for re-injection through the sight tube into the reaction chamber. This may require additional equipment (e.g. oil-free compressor, gas cleaning equipment, etc.) which adds to operations and maintenance expense.

Alternately, if a non-process gas (e.g. an inert gas such as nitrogen) is used as the purge gas, the product from the reaction chamber will be slightly diluted by the pyrometer purge gas. If the gasifier is producing a synthesis gas for a chemical process, the presence of a diluent gas may not be acceptable.

Bearing in mind the above descriptions, the present invention overcomes the problems encountered with both thermocouples and optical pyrometers mounted external to the side walls of a gasifier.

Referring to FIG. 1, a quench mode gasification reactor 10, hereafter called gasifier, utilizes a particulated carbonaceous fuel as feedstock which it will receive as a coal slurry formed from the mixing of coal and water provided by a coal slurry source 12. The coal slurry is provided to a burner 16 by way of a line 20. Oxygen is also provided to burner 16 from a source 22 through a line 24. Burner 16 will be described in greater detail hereinafter. Oxygen source 22 also provides oxygen to temperature control means 26 which in turn provides oxygen at a predetermined temperature to burner 16 by way of a line 28. Coupled to burner 16 is a pyrometric sensing means 33. Cooling water enters burner 16 by a line 34 and leaves burner 16 by a line 35.

Gasifier 10 includes a steel shell 36 which is sufficiently strong to withstand the high temperatures and pressures normally encountered within a reaction chamber 40. Refractory material 45 forms chamber 40. The fuel and oxidant being fed into reaction chamber 40 auto-ignites causing a reaction within a temperature range of about 2000°-2800° F.

The combustion process yields raw syngas and slag which gravitates toward the wall of refractory material reaction chamber 40 and flows downwardly to the bottom of chamber 40 and down a dip tube 53. Dip tube 53 enters a chamber 58 formed by a lower portion of shell 36 and extends into a pool of water 65.

Cooling water enters a line 70 and is provided to a quench ring 72 where it flows down the inside of dip tube 53 into the pool of water 65. In the process it cools the raw syngas and slag. Water from pool 65 is removed by way of a line 77. Obviously the water provided through line 70 and the water being removed by way of a line 77 is controlled to maintain a desired level for pool of water 65.

The raw syngas bubbles up to that portion of chamber 58 above the water level of pool 65 and is removed by a line 83. The heavier slag falls to the bottom of chamber 58 and into a line 87 having a valve 90. Line 87 is connected to slag trap means 94 which is connected to a line 98 having a valve 100. During normal operations valve 90 is open and the slag passes through line 87 and is trapped in slag trap means 94 due to valve 100 being closed. The slag is removed by closing valve 90 and opening valve 100 to remove the slag.

Figure 2:
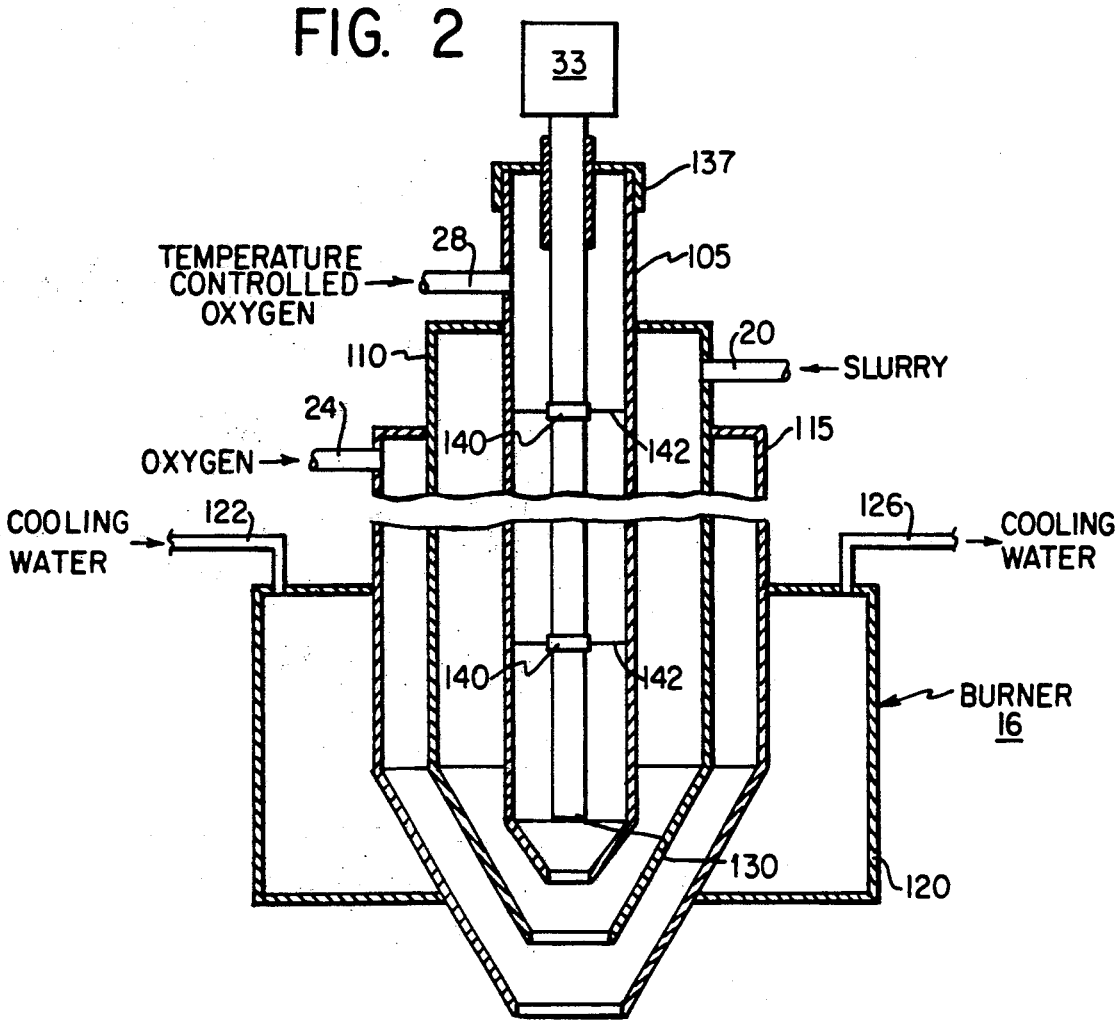
FIG. 2 is a more detailed representation of the burner and pyrometer shown in FIG. 1.

With reference also to FIG. 2, burner 16 includes an inner cylinder 105 connected to line 28 and receiving temperature controlled oxygen which passes through cylinder 105 into reaction chamber 40. Affixed to inner cylinder 105 is another cylinder 110 connected to line 20 in which the slurry mix from line 20 enters cylinder 110 and passes into combustion chamber 40.

Yet a third cylinder 115 connected to line 24 and affixed to cylinder 110 provides the oxygen to the combustion chamber 40. As can be seen in FIG. 2, cylinders 105, 110 and 115 have their ends tapered to form a nozzle effect and to aid in the mixing of the slurry and the oxygen just prior to entry into reaction chamber 40.

Also affixed to outer cylinder 115 is a water jacket 120 receiving cooling water from a line 122. Cooling water exits the jacket 120 through a line 126. The cooling effect of the water in water jacket 120 protects the metal burner tip from the intense heat within the reaction chamber.

Inserted in cylinder 105 is a sensing tube 130 which receives infrared radiation, or lack thereof, from the reaction of the slurry and oxygen mix in reaction chamber 40 and provides it to pyrometric means 33 which provides an indication of the temperature in the reaction chamber. Inner cylinder 105 has a cap 137 which effectively seals off the one end of cylinder 105 and cooperates with collars 140 and support members 142 in permitting the flow of oxygen within cylinder 105 while at the same time maintaining sensing tube 130 in place.

Figure 3:
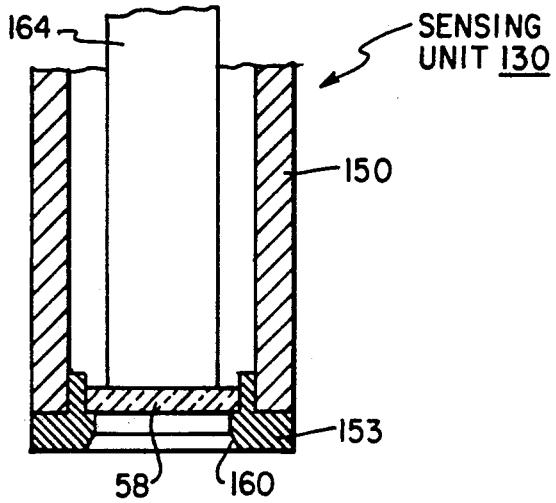
FIG. 3 is a detailed representation of the sensing unit shown in FIG. 2.

Referring also to FIG. 3, sensing tube 130 includes a housing 150 which may be any high temperature metal such as INCONEL 600. At the end of housing 150 nearest combustion chamber 40, is an end piece 153 with an opening 160. Affixed to end piece 153 is a high pressure sight glass 158, which may be commercial quartz. A bundle 164 of fiberoptics located within housing 150 conveys infrared radiation from the reaction chamber, which has passed through sight glass 158, to pyrometric means 33.

Referring again to FIG. 2, note that the sensing tube 130, which transmits infrared radiation to the pyrometric sensor 33, is continuously purged with oxygen controlled at an appropriate temperature and flow rate. The optical path of the pyrometric temperature sensor is therefore purged with a clean process gas which does not dilute the reactor effluent. Because oxygen is normally fed into the gasifier reaction chamber via the burner, no additional equipment is required. Also, by referring to FIG. 1, note that the optical sight path of the sensor is located in a region of the gasifier 10 which is removed from the side wall of the reaction chamber 40 where slag tends to accumulate as it flows downward towards the dip tube 53.

What is claimed is:

1. A burner comprising:

nozzle means receiving coal slurry and oxygen for providing a reactive mixture thereof to a reaction chamber of a coal gasification system where combustion takes place, and pyrometer means connected to the nozzle means for sensing the temperature of the reaction of the coal slurry and the oxygen through the nozzle means.

2. A burner as described in claim 1 further comprising means receiving oxygen for controlling the temperature of the received oxygen and providing the temperature controlled oxygen to the burner in a manner so as to cooperate with the pyrometer means.

3. A burner as described in claim 2 in which the pyrometer means includes:

sensing means for sensing the infrared radiation from the reactions, a pyrometer connected to the sensing means which provides an indication of the temperature of reaction in accordance with the infrared radiation sensed by the sensing means.

4. A burner as described in claim 3 in which the nozzle means includes:

an outer nozzle means for receiving oxygen at the second temperature, a middle nozzle means spatially arranged with the outer nozzle means for receiving the coal slurry, and an inner nozzle means spatially related to the middle nozzle means for receiving the oxygen at the first predetermined temperature; and in which all the nozzle means together provides the oxygen and the coal slurry to the reaction chamber in such a manner as to form a mixture which spontaneously reacts upon entering the reaction chamber.

5. A burner as described in claim 4 in which the sensing means is located substantially inside the inner nozzle means, and the pyrometer is located outside of the inner nozzle means.

6. A burner as described in claim 5 in which the sensing means includes:

a housing, sight means affixed to the housing for passing infrared radiation from the reaction, and means located with the housing spatially arranged with the sight means and the pyrometer for conveying the passed infrared radiation from the sight means to the pyrometer.

* * * * *